US006808754B2

(12) United States Patent
Congard et al.

(10) Patent No.: US 6,808,754 B2
(45) Date of Patent: Oct. 26, 2004

(54) DEVICE AND METHOD FOR SUPPLYING ATOMIZERS, AND SPRAYING INSTALLATION EQUIPPED WITH SUCH A DEVICE

(75) Inventors: Jean Charles Congard, Saint Martin d'Uriage (FR); Philippe Foury, Crolles (FR); Eric Prus, Grenoble (FR)

(73) Assignee: Sames Technologies, Meylan (FR)

( * ) Notice: Subject to any disclaimer, the term of this patent is extended or adjusted under 35 U.S.C. 154(b) by 550 days.

(21) Appl. No.: 09/982,063

(22) Filed: Oct. 19, 2001

(65) Prior Publication Data

US 2002/0046698 A1 Apr. 25, 2002

(51) Int. Cl.[7] ..... B05D 1/02

(52) U.S. Cl. ..... 427/424; 118/300; 118/314; 118/323; 118/324

(58) Field of Search ..... 118/300, 314, 118/323, 324; 427/424

*Primary Examiner*—Bernard Pianalto
(74) *Attorney, Agent, or Firm*—Browdy and Neimark, P.L.L.C.

(57) ABSTRACT

This device for supplying coating products to the atomizers of an installation for spraying coating products on objects to be displaced by a conveyor, comprises at least one principal tank, adapted to supply secondary tanks each intended for an atomizer, at least one station for distributing the contents of the principal tank between the secondary tanks, and means for displacing the full secondary tanks towards application robots adapted to displace said atomizers opposite said objects. Each secondary tank forms with the atomizer for which it is intended, a sub-assembly adapted to be displaced, by the afore-mentioned displacement means, between an application member and the distribution station, and vice versa.

13 Claims, 4 Drawing Sheets

DEVICE AND METHOD FOR SUPPLYING ATOMIZERS, AND SPRAYING INSTALLATION EQUIPPED WITH SUCH A DEVICE

FIELD OF THE INVENTION

The present invention relates to a device and a method for supplying coating products to the atomizers of an installation for spraying coating products.

BACKGROUND OF THE INVENTION

It is known to supply the atomizers of an installation for spraying coating products via product circulation conduits, also known as "circulatings", from large-capacity tanks of products, whose capacity may attain several thousands of liters. Such tanks are generally located in storage premises at a distance from the spraying installations. Taking into account the usual distance between the store and the spraying installation, the products present in the circulatings during operation are of the order of several hundreds of liters, which renders it economically impossible to change products in such circulatings, as the quantities of products lost thereby are inacceptable. It is therefore necessary to provide one circulating per shade of colour used.

Now, the number of shades used in an installation for spraying coating products is tending to increase, which induces an increase in the number of circulating lines and increases the cost of the installation accordingly, while problems of space requirement are raised, particularly at the level of the passages through partitions.

The use of tanks borne on the arm of a multi-axis robot does not necessarily enable this problem to be solved. In effect, in the system known from EP-A-0 274 322, coating product circulatings are provided up to the zone of activity of the robot. In other systems, such as disclosed for example in EPA-0 796 665, a carrousel is provided for filling cartridges with coating products but circulatings for supplying coating products are provided up to the vicinity of this carrousel for filling the cartridges.

In all cases, the permanent stirring of the coating products in the circulatings leads to a degradation of their physico-chemical properties due to the mechanical stresses to which they are subjected, in particular the shear undergone at the level of the changes in direction, the pumps or the pressure regulators.

Another solution known from DE-A-197 04 573 consists in using prefilled cartridges, which are for example disposable, but this leads to complex manipulations of a large number of cartridges, which is not economically satisfactory and renders the system of management of such an installation considerably complex.

It is a particular object of the present invention to overcome these problems by proposing a novel atomizer supply device which does not necessitate the construction of a circulating up to the vicinity of an installation and avoids the manipulation of too large a number of cartridges.

SUMMARY OF THE INVENTION

To that end, the invention relates to a device for supplying coating products to the atomizers of an installation for spraying coating products on objects to be displaced by a conveyor, this device comprising at least one principal tank, adapted to supply secondary tanks each intended for an atomizer, at least one station for distributing the contents of the principal tank between the secondary tanks, and means for displacing the full secondary tanks towards application members adapted to displace the atomizers opposite the objects to be coated. Each secondary tank forms with the atomizer for which it is intended, a sub-assembly adapted to be displaced, by the afore-mentioned displacement means, between an application member and the distribution station, and vice versa.

The principal tank or tanks make it possible to supply different secondary tanks of the installation without the use of expensive and cumbersome circulatings. The principal tanks may be packaged outside the factory in which the installation is employed and, in particular, in the premises of the coating product manufacturer, the principal tanks in that case corresponding to a particular packaging of the product. It then suffices to transport different principal tanks up to the distribution station, which is installed near the spraying installation, then to transfer the contents of the principal tank into different secondary tanks which may then be conducted towards the application members which may be robots. The secondary tanks are used successively in the installation, which means that it is unnecessary to manage a large number of individual cartridges. Thanks to the connection of the secondary tanks and the atomizers, the sub-assemblies are displaced in unitary fashion between the application members and the distribution station in which the atomizers and the tanks can be cleaned before the secondary tanks are filled. This considerably simplifies the manipulations of the tanks and allows a good compactness of the elements mounted on the application members, for example at the level of the wrists of the multi-axis robots.

According to advantageous aspects of the invention, the device incorporates one or more of the following characteristics:

Units for temporary storage of the sub-assemblies are each arranged in the zone of activity of at least one application member. This makes it possible to conduct the sub-assemblies towards the application members, or from the latter in return towards the filling station, in masked time, independently of the cycle time of the application members.

The distribution station is located at the level of a median part of the installation, this station being connected by first displacement means to the application member(s) located upstream with respect thereto and in the direction of displacement of the sub-assemblies, and by second displacement means to the application member(s) located downstream. The positioning of the distribution station reduces the paths of displacement of the sub-assemblies, which consequently makes it possible to reduce the cycle times.

The or each principal tank is adapted to contain a quantity of coating product sufficient to supply the secondary tanks intended for the atomizers of the installation for completely coating an object or part of an object. In this way, a principal tank may for example make it possible to supply all the atomizers located on one side of the installation, or on half of such a side, with a suitable quantity of paint, without waste. In a variant, the quantity of product present in the principal tank corresponds to the complete coating of an object, the secondary tanks in that case being distributed between the application members or robots located on the two sides of the objects displaced by the conveyor.

The displacement means comprise at least one conveyor, adapted to displace the sub-assemblies from the distribution station up to the vicinity of the application members. This conveyor is associated with units for temporarily storing the sub-assemblies, these units each being disposed in the zone of activity of at least one application member. The temporary storage units make it possible to distribute the secondary tanks in masked time with respect to the phases of applications of coating product, the interruption of the spraying essentially corresponding to a change of tank and/or of sub-assembly comprising such a tank, for each application member, such as a robot. In a first embodiment, each unit comprises two locations for temporarily receiving sub-assemblies each incorporating a secondary tank, an application member being able to alternately deposit and remove such a sub-assembly in and out of these locations. In a second embodiment, two units are provided for each application member, first units being intended for the temporary storage of sub-assemblies each incorporating a secondary tank before their use by an application member, while second units are intended for temporary storage of such sub-assemblies after their use by an application member. In that case, the first and second temporary storage units may be connected to the distribution station by two different sections of the same conveyor or by two independent conveyors.

The distribution station comprises a carrousel on whose periphery the sub-assemblies may be disposed and at whose centre principal tanks may be disposed.

The invention also relates to a method which may be carried out with the device described hereinbefore and, more specificially, to a method which comprises the steps consisting in:

transferring a coating product from a principal tank into secondary tanks;

conducting the secondary tanks up to the vicinity of application members adapted to displace the atomizers opposite the objects to be coated, and fixing the secondary tanks on the application members, method in which the secondary tanks are conducted in sub-assemblies each also comprising at least one atomizer associated with each secondary tank.

According to advantageous aspects of the invention, the method may comprise the following additional steps:

The sub-assemblies are temporarily stored in the vicinity of the application members in units provided to that end and each disposed in the zone of activity of at least one application member.

The principal tank is filled with a sufficient quantity of product for coating the same object or a part of the same object by different atomizers and the atomizers are supplied by means of secondary tanks filled by transfer from this principal tank.

Finally, the invention relates to an installation for spraying coating products comprising a device as described hereinabove, possibly employed with the aid of the method as described hereinabove. The cost price of such an installation is substantially less than the known installations having to be supplied with circulatings and it is much simpler to use than an installation supplied with cartridges each intended for an atomizer.

BRIEF DESCRIPTION OF THE DRAWINGS

The invention will be more readily understood on reading the following description of two embodiments of an installation in accordance with its principle, given solely by way of example and made with reference to the accompanying drawings, in which.

DESCRIPTION OF PREFERRED EMBODIMENTS

Figure 1:
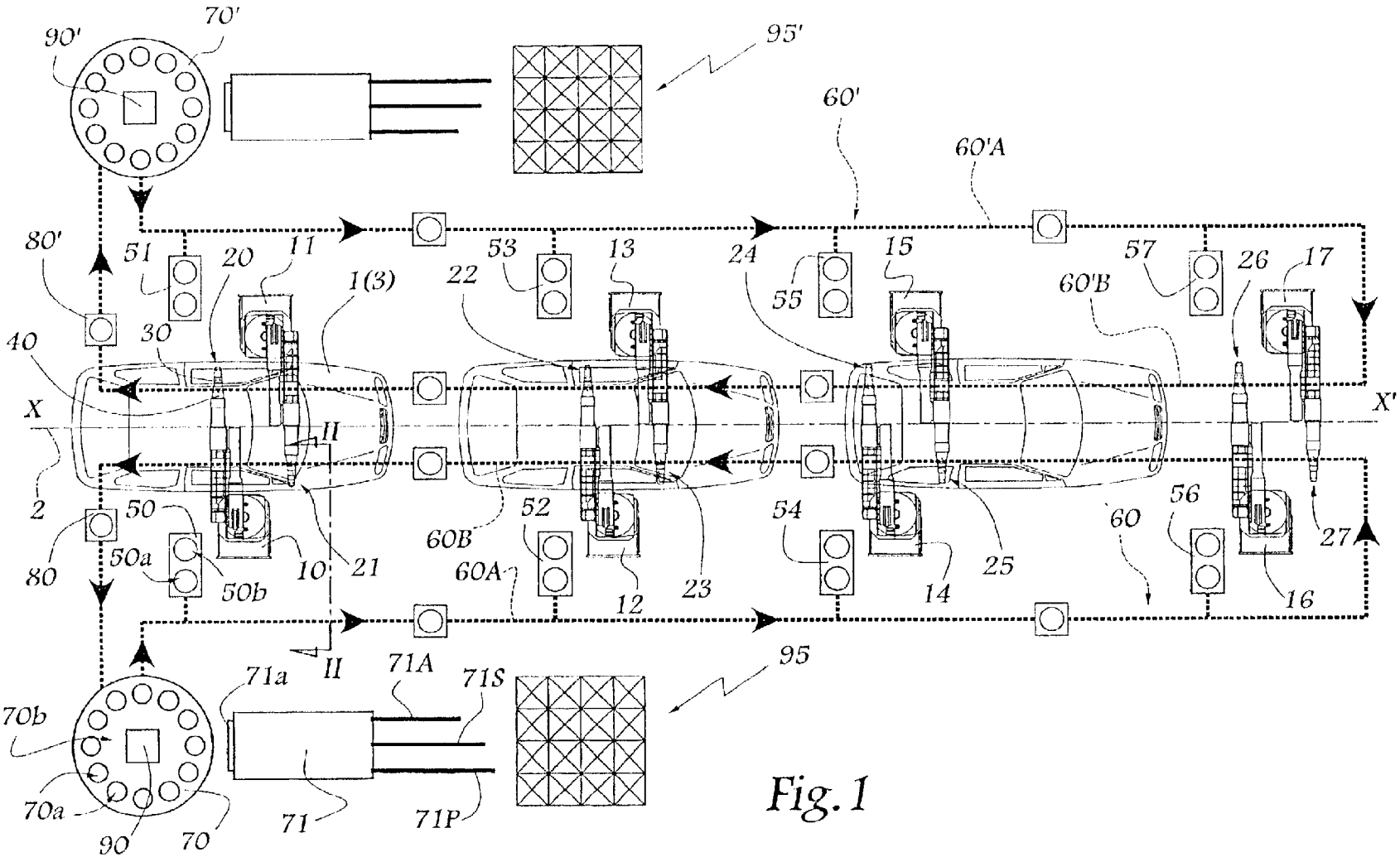
FIG. 1 schematically shows, in plan view, an installation according to a first embodiment of the invention.

Referring now to the drawings, the installation shown in FIG. 1 is provided for coating automobile vehicle bodies 1 with liquid paint, said bodies being displaced by a conveyor 2 in a substantially rectilinear direction X—X'. The bodies 1 are each supported by a carriage or toboggan 3 driven by the conveyor 2.

Multi-axis robots 10 to 17 forming application members are distributed on either side of the conveyor 2 and the toboggans 3 and are each equipped with a sub-assembly 20 to 27 including a coating product spray atomizer and a tank for supplying this atomizer.

Figure 2:
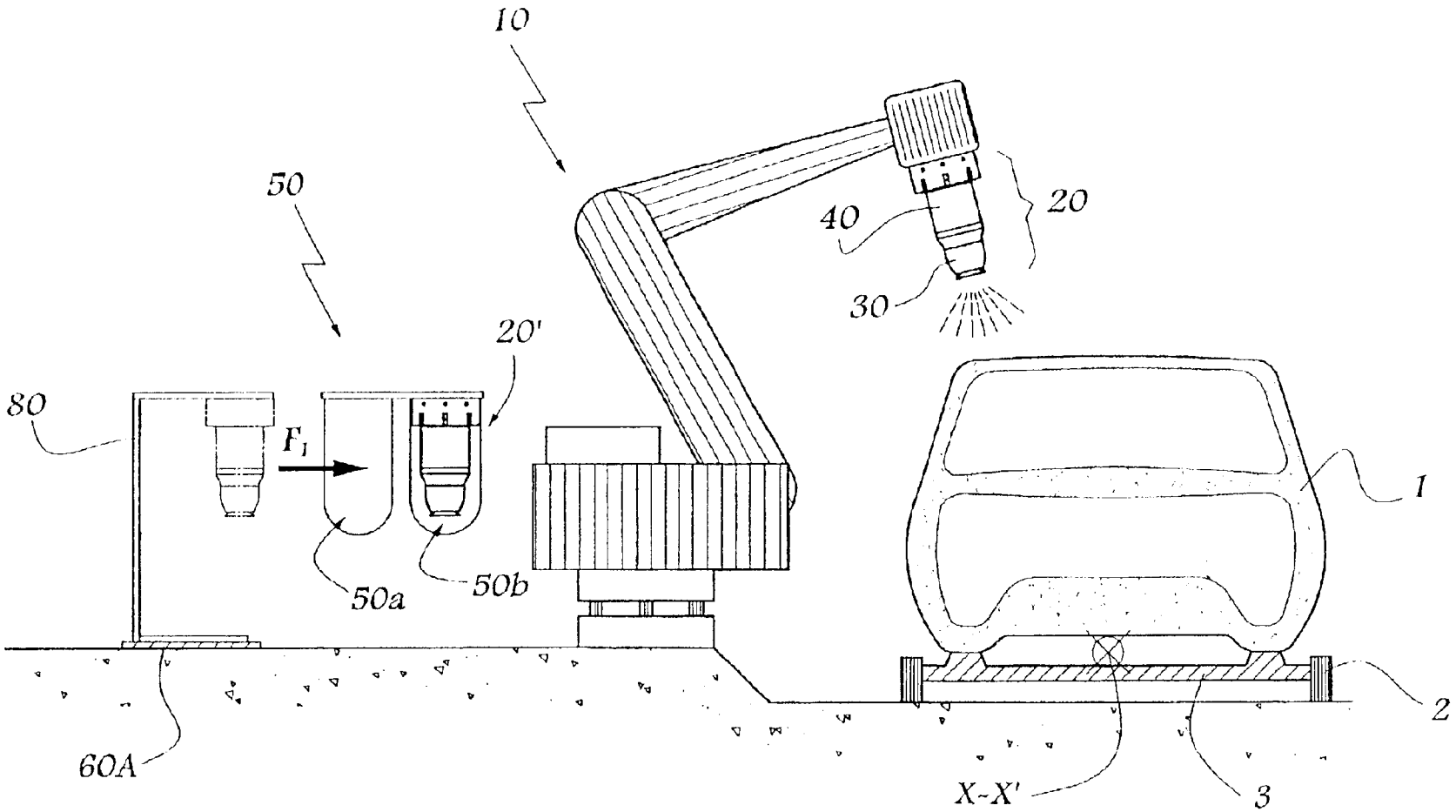
FIG. 2 is a partial section, on a larger scale and along line II—II, of part of the installation of FIG. 1.

The sub-assembly 20 of the robot 10 is more particularly visible in FIG. 2 where its atomizer 30 and the tank 40 associated therewith can be identified. The other sub-assemblies 21 to 27 present the same structure.

The sub-assemblies 20 to 27 are removably mounted at the end of the arm of the robots 10 to 17 for the duration of the spraying on a body, the content of each tank, 40 or equivalents, being sufficient to allow the desired application of coating product on the body in question.

The robots 10 to 13 may be provided to be intended for the application of a first layer of coating inside a body, while robots 14 to 17 are intended for applying a second layer inside these bodies.

According to a variant of the invention (not shown), the installation may comprise other robots intended respectively for the application of a first layer and a second layer outside the body, a manual retouching station possibly being provided in the downstream part of the booth of the installation.

After a body has been coated, each sub-assembly 20 to 27 must be cleaned and the tank 40 or equivalent that it comprises must be filled with a fresh coating product, most often different from that used previously, as automobile vehicles are painted as a function of the customers' orders.

To that end, there is provided in the vicinity of each robot a unit 50 to 57 for temporary storage of sub-assemblies of the type such as sub-assemblies 20 to 27. As is more particularly visible in FIG. 2, the unit 50 comprises two locations 50*a* and 50*b* for receiving sub-assemblies intended to be mounted on the robot 10. More specifically, the location 50*a* is empty and ready to receive sub-assembly 20, while a similar sub-assembly 20' is in place in the location 50*b*. The robot 10 alternately deposits a sub-assembly in one of the locations 50*a* and 50*b* and removes a similar sub-assembly from the other location.

Stations 50 to 57 are supplied with sub-assemblies 20 to 27 which are clean and full, with the aid of a conveyor 60.

The conveyor 60 is provided to conduct, from a carrousel 70, chassis 80 in which are supported sub-assemblies of the type such as sub-assemblies 20 to 27. The conveyor 60 is thus adapted to bring a chassis 80 opposite a station 50 or equivalent, a transfer being able to take place by any appropriate means for bringing the sub-assembly 20 borne by the chassis 80 into one of the locations 50*a* or 50*b* of the station 50, as represented by arrow $F_1$ in FIG. 2.

A reverse movement is provided in order to evacuate an empty sub-assembly 20 or 20' to be cleaned, deposited in the unit 50 by the robot 10 after a spraying operation. The conveyor 60 and the different chassis 80 therefore make it possible to circulate sub-assemblies 20 and equivalent between the carrousel 70 and the units 50 to 57, and vice versa.

The carrousel 70 comprises, on its periphery, a plurality of housings 70*a* for receiving the sub-assemblies 20 and equivalent. The carrousel 70 is associated with a station 71 connected to an air supply conduit 71A and solvent supply conduit 71S. The station 71 is connected to a drain by a conduit 71P. The station 71 comprises mobile connection means 71*a* for connection thereof to the sub-assembly received in the nearest housing 70*a*, which makes it possible to proceed with the draining of the tank of this sub-assembly and with the cleaning of this tank and the atomizer associated therewith. In this way, the different sub-assemblies present in the carrousel 70 may be cleaned by the station 71 after having been conducted by the conveyor 50 and before being filled again.

In its central part 70*b*, the carrousel 70 is provided to receive principal tanks 90 whose content is sufficient to supply the tanks of four sub-assemblies 20, 22, 24 and 26 respectively intended for robots 10, 12, 14 and 16, which makes it possible to coat the right-hand side of an automobile vehicle body with the same product.

In certain cases, the part 70*b* may receive a plurality of principal tanks 90 simultaneously in order to supply the sub-assemblies 120 and equivalent with different products.

The different principal tanks 90 are packaged outside the automobile vehicle coating unit and conducted up to a rack 95 from which they are displaced up to the centre of the carrousel 70 by a manipulator robot (not shown) or by an operator.

A carrousel 70' is also provided on the opposite side of the conveyor 2 and is associated with a conveyor 60' which conducts chassis 80' up to the temporary storage units 51, 53, 55 and 57, the chassis 80' including sub-assemblies 21, 23, 25 and 27 provided for the robots 11, 13, 15 and 17.

Similarly, a rack 95' is provided for the arrangement of principal tanks 90' in the vicinity of the carrousel 70', the content of the principal tanks 90' being sufficient to supply four tanks of sub-assemblies respectively intended for robots 11, 13, 15 and 17.

Figure 3:
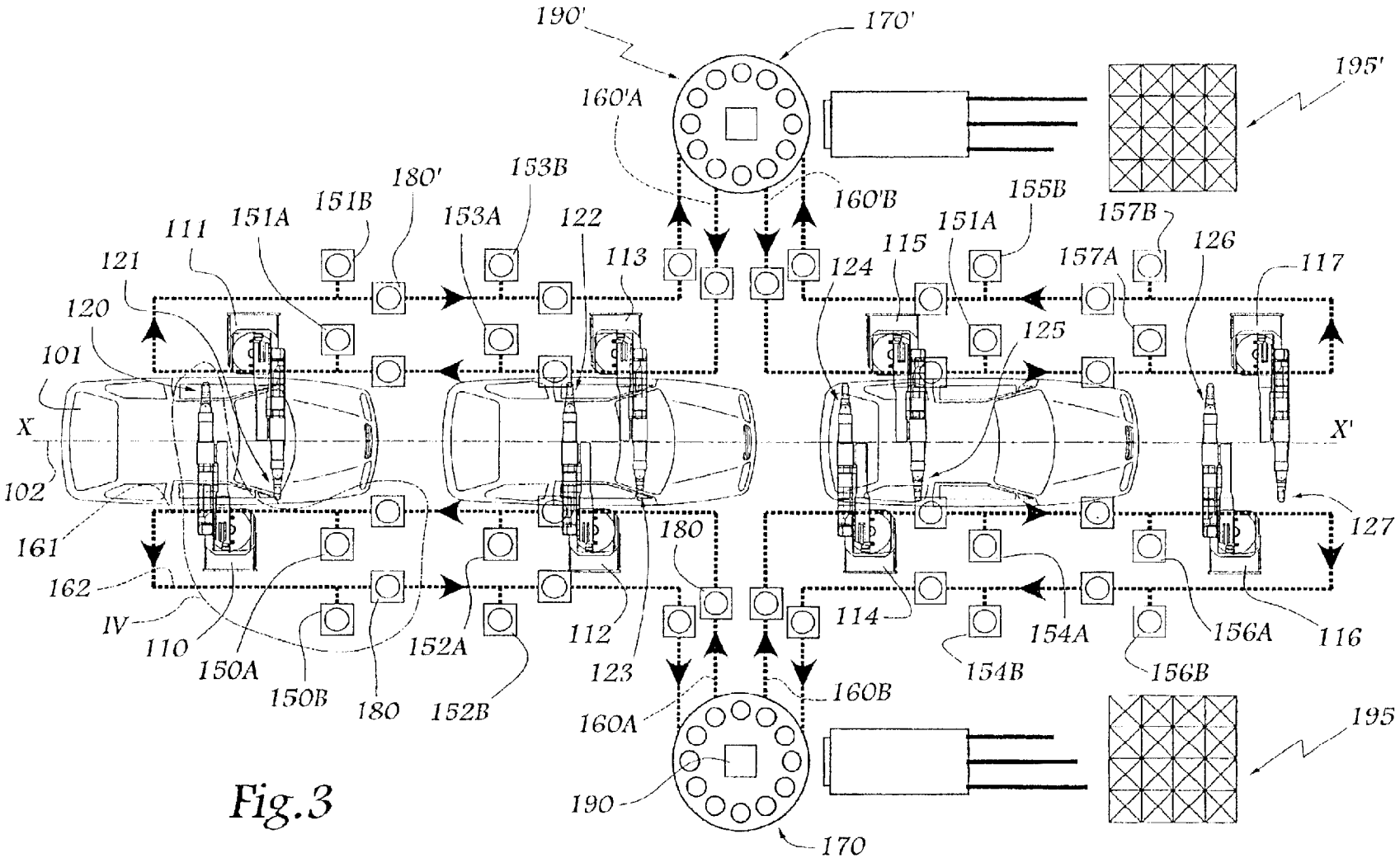
FIG. 3 is a view similar to FIG. 1 for an installation according to a second embodiment of the invention.

In the second embodiment of the invention shown in FIG. 3, the elements similar to those of the first embodiment bear identical references increased by 100. This embodiment differs from the preceding one in that the carrousels 170 and 170' are disposed in a median zone of the installation and are connected by a first conveyor 160A or 160'A to robots 110 and 112 or 111 and 113 and by a second conveyor 160B or 160'B to robots 114 and 116 or 115 and 117. As previously, the carrousels 170 and 170' are supplied with principal tanks 190 and 190' from racks 195 and 195', the content of a principal tank 190 or 190' making it possible to supply sub-assemblies 120 and equivalent intended for the four robots 110, 112, 114 and 116 or 11, 113, 115 and 117.

Compared to the first embodiment, the conveyors 160A, 160B, 160'A and 160'B are substantially shorter than conveyors 60 and 60', which enables time to be saved during the conducting of the chassis 180 and 180' up to the robots 110 to 117 or from the latter.

Figure 4:
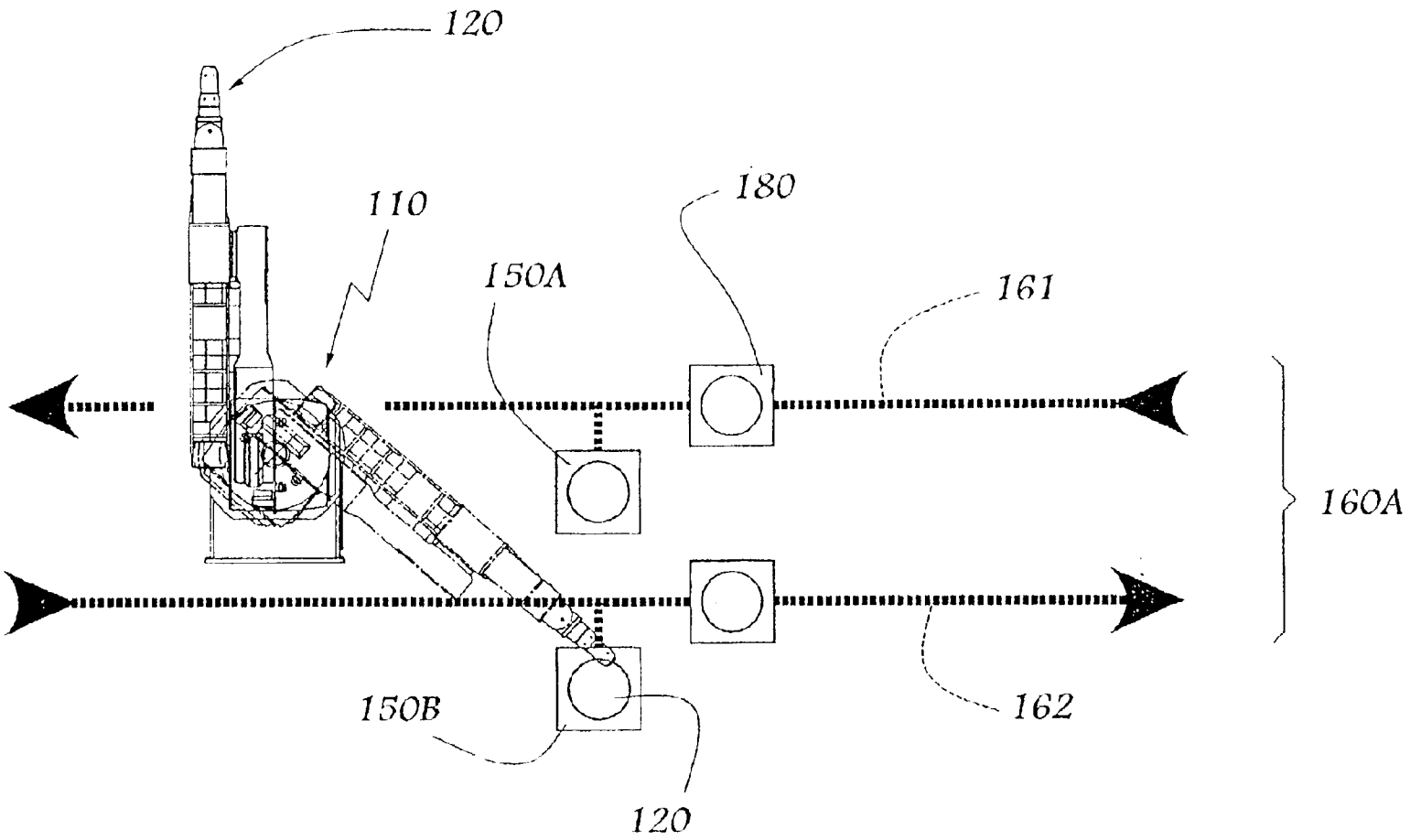
FIG. 4 is a view on a larger scale of detail IV of FIG. 3.

Units 150A and 150B for temporarily storing sub-assemblies 120 are arranged in the vicinity of the robot 110, robot 110 being able to attain these units by passing from a position of spraying shown in solid lines in FIG. 4 to a position of transfer shown in dashed-and-dotted lines. The conveyor 160A comprises two sections 161 and 162 which are substantially rectilinear and extend parallel to the direction X—X' of conveyance of the bodies 101 by the conveyor 102.

The section 161 serves to convey full sub-assemblies towards the robots 110 and 112, while section 162 serves for the evacuation, in the direction of carrousel 170, of the sub-assemblies after use. The station 150A is intended to be supplied with sub-assemblies 120 from the section 161 of the conveyor 160A. As for section 162, it is provided to evacuate the sub-assemblies 120 deposited in the unit 150B by the robot 110. In this way, units 150A and 150B together perform substantially the same function as unit 50 of the first embodiment, their construction, as well as their functioning, being simple.

After an operation of application, the robot 110 pivots in order to attain the position shown in dashed-and-dotted lines in FIG. 4 and deposits in station 150B the sub-assembly 120 with which it is equipped. The robot 110 then pivots in the direction of unit 150A from which it removes a sub-assembly 120 previously conducted to this station by the conveyor 160A. The robot 110 may then return to its position of application shown in solid lines in FIG. 4.

The sub-assemblies 120 and equivalent are transported on the conveyors 160A, 160B, 160'A and 160'B in chassis 180 and 180'. These chassis may take any suitable forms. It is also possible to dispense with using such chassis, in which case housings for transporting the sub-assemblies 120 and equivalent are provided in the conveyors 160A and equivalent.

Other pairs of units for temporarily storing the sub-assemblies 121 to 127 are provided in the vicinity of the robots 111 to 117 and bear references 151A, 151B to 157A, 157B.

In the two embodiments described, the stations 50 to 57, 150A to 157A and 150B to 157B are advantageously provided inside a spraying booth, while the conveyors 60, 160 and equivalent are disposed outside this booth, for example at a different level. In that case, these units are loaded and unloaded with sub-assemblies 20, 120 and equivalent through a passage in the partition of this booth.

The invention has been described with an installation for spraying liquid coating products. It is applicable to the spraying of all types of liquid products containing solvents, hydrosoluble or composed of two components, and to the spraying of pulverulent coating products.

The invention has been represented in the case of an installation for coating automobile vehicle bodies. However, it is applicable to the coating of all types of objects, particularly spare parts, by means of atomizers of all types, electrostatic or not, rotary or pneumatic.

The invention has been described with conveyors 60 or 160 successively supplying a plurality of robots. However, it is also applicable to the case of independent conveyors being used for the different robots and even to the case of two independent conveyors conducting and recovering the sub-assemblies 120 to 127 in two temporary storage stations associated with each robot 110 to 117 in the second embodiment. According to another variant, one conveyor may conduct the sub-assemblies towards the stations 150A to 157A for storage of full sub-assemblies for the different robots, while another conveyor serves to evacuate towards the distribution station 170 the sub-assemblies already used by the robots 110 to 117 and deposited in the temporary storage stations 150B to 157B.

The invention has been represented with multi-axis robots. It is applicable with any type of robot adapted to displace at least one atomizer opposite objects to be coated, in particular with machines of "reciprocator" type or of the type known from EP 0 720 515. The invention might also be carried out in an installation comprising a succession of manual coating stations, in which case the application members would be the painters' guns.

Whatever the variant considered, one or more atomizers mounted on the same robot or the same machine may be supplied from the same secondary tank.

The distribution stations 70, 70', 170 or 170' are not necessarily carrousels. They may be linear loading/unloading magazines.

What is claimed is:

1. Device for supplying coating products to the atomizers of an installation for spraying coating products on objects to be displaced by a conveyor, said device comprising at least one principal tank, adapted to supply secondary tanks each intended for an atomizer, at least one station for distributing the contents of said principal tank between said secondary tanks, and means for displacing said full secondary tanks towards application members adapted to displace said atomizers opposite said objects, wherein each secondary tank forms with the atomizer for which it is intended, a sub-assembly adapted to be displaced, by said displacement means, between an application member and said distribution station, and vice versa.

2. The device of claim 1, wherein it comprises units for temporary storage of the sub-assemblies, said units each being disposed in the zone of activity of at least one application member.

3. The device of claim 1, wherein said distribution station is located at the level of a median part of said installation, said station being connected by first means for displacement of the sub-assemblies to the or each application member located upstream, with respect to it and in the direction of displacement of said objects, and by second means for displacement of the sub-assemblies to the or each application member located downstream.

4. The device of claim 1, wherein the or each principal tank is adapted to contain a sufficient quantity of coating product to supply the secondary tanks intended for the atomizers of the installation for completely coating an object or part of an object.

5. The device of claim 1, wherein said displacement means comprise at least one conveyor, adapted to displace said sub-assemblies from said distribution station up to the vicinity of said application members, said conveyor being associated with units for temporary storage of said sub-assemblies, said units each being disposed in the zone of activity of at least one application member.

6. The device of claim 5, wherein each unit comprises two locations for temporarily receiving sub-assemblies each incorporating a secondary tank, an application member being adapted alternately to deposit and remove such a sub-assembly in and from said locations.

7. The device of claim 5, wherein said units are at least two in number for each application member, first units being intended for the temporary storage of sub-assemblies each incorporating a secondary tank before their use by an application member, while second units are intended for the temporary storage of sub-assemblies after their use by a robot.

8. The device of claim 7, wherein said first and second temporary storage units are connected to said distribution station by two different sections of the same conveyor or by two independent conveyors.

9. The device of claim 1, wherein said distribution station comprises a carrousel on whose periphery said sub-assemblies may be disposed and at whose centre principal tanks may be disposed.

10. Installation for spraying coating products comprising a device according to claim 1.

11. Method for supplying coating products to at least one atomizer of an installation for spraying coating products, said method comprising the steps consisting in:

transferring a coating product from a principal tank into secondary tanks;

conducting said secondary tanks up to the vicinity of application members adapted to displace the atomizers opposite said objects, and fixing said secondary tanks on said application members, wherein said secondary tanks are conducted in sub-assemblies each also comprising at least one atomizer (30) associated with each secondary tank.

12. The method of claim 11, wherein it consists in filling said principal tank with a sufficient quantity of product for coating the same object or a part of the same object by different atomizers and supplying said atomizers by means of secondary tanks filled by transfer from said principal tank.

13. The method of claim 11, wherein the sub-assemblies are temporarily stored in the vicinity of the application members in units each disposed in the zone of activity of at least one application member.

* * * * *